US011136521B2

(12) United States Patent
De Feo

(10) Patent No.: US 11,136,521 B2
(45) Date of Patent: Oct. 5, 2021

(54) USE OF ESTERS IN A LUBRICANT COMPOSITION FOR IMPROVING CLEANLINESS OF AN ENGINE

(71) Applicant: TOTAL MARKETING SERVICES, Puteaux (FR)

(72) Inventor: Modestino De Feo, Venissieux (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 16/646,229

(22) PCT Filed: Sep. 18, 2018

(86) PCT No.: PCT/EP2018/075223
§ 371 (c)(1),
(2) Date: Mar. 11, 2020

(87) PCT Pub. No.: WO2019/057718
PCT Pub. Date: Mar. 28, 2019

(65) Prior Publication Data

US 2020/0270542 A1 Aug. 27, 2020

(30) Foreign Application Priority Data

Sep. 19, 2017 (FR) ..... 1758648

(51) Int. Cl.

| | |
|---|---|
| ***C10M 129/74*** | (2006.01) |
| ***C10M 129/70*** | (2006.01) |
| ***C10M 129/72*** | (2006.01) |
| ***C10M 169/04*** | (2006.01) |
| ***C10N 20/02*** | (2006.01) |
| ***C10N 30/04*** | (2006.01) |
| ***C10N 40/26*** | (2006.01) |
| ***C10N 40/25*** | (2006.01) |

(52) U.S. Cl.
CPC ..... *C10M 129/74* (2013.01); *C10M 129/70* (2013.01); *C10M 129/72* (2013.01); *C10M 169/045* (2013.01); *C10M 2207/281* (2013.01); *C10M 2207/282* (2013.01); *C10M 2207/283* (2013.01); *C10N 2020/02* (2013.01); *C10N 2030/04* (2013.01); *C10N 2040/25* (2013.01); *C10N 2040/26* (2013.01)

(58) Field of Classification Search
CPC ..... C10M 129/68; C10M 129/70; C10M 129/72; C10M 129/74; C10M 169/045; C10M 2207/281; C10M 2207/282; C10M 2207/283; C10M 2020/02; C10M 2030/04; C10M 2040/25; C10M 2040/26
See application file for complete search history.

(56) References Cited

U.S. PATENT DOCUMENTS

| | | | | |
|---|---|---|---|---|
| 6,462,001 | B1 * | 10/2002 | Kenbeek | C10M 105/42 508/492 |
| 6,844,299 | B2 | 1/2005 | Bessonette et al. | |
| 7,875,580 | B2 * | 1/2011 | Oldfield | C10M 145/22 508/492 |
| 9,637,702 | B2 | 5/2017 | Lancon | |
| 2002/0042348 | A1 * | 4/2002 | McNeil | C10M 143/00 508/118 |
| 2009/0163393 | A1 * | 6/2009 | Boffa | C10M 111/04 508/496 |

FOREIGN PATENT DOCUMENTS

| | | | |
|---|---|---|---|
| FR | 2144559 | 2/1973 | |
| GB | 1390439 | 4/1975 | |
| GB | 1390439 A * | 4/1975 | C10L 1/143 |

OTHER PUBLICATIONS

International Search Report for PCT/EP2018/075223, dated Nov. 8, 2018.
Written Opinion of the International Searching Authority for PCT/EP2018/075223, dated Nov. 8, 2018.
Preliminary Search Report for FR 1758648, dated May 8, 2018.
Peter Greven Your partner for ester lubricants, Peter Greven GmbH & Co. KG, 2016, XP002780891, Retrieved from the Internet: URL:https://www.peter-greven.de/fileadmin/user_upload/dweber/PG/PDFs/Broschueren/PG_LUBRICANTS 2016 erg.pdf [retrieved-on May 8, 2018] pp. 4, 5, 14.

* cited by examiner

*Primary Examiner* — James C Goloboy
(74) *Attorney, Agent, or Firm* — B. Aaron Schulman, Esq.; Stites & Harbison, PLLC

(57) ABSTRACT

The present application relates to the use, in a lubricant composition comprising at least one base oil, of 2 to 12% by weight, relative to the weight of said lubricant composition, of an ester that has a viscosity at 100° C. of between 200 and 1000 cSt, for the purpose of improving the cleanliness of an engine.

10 Claims, No Drawings

USE OF ESTERS IN A LUBRICANT COMPOSITION FOR IMPROVING CLEANLINESS OF AN ENGINE

This invention concerns the use of esters in a lubricant composition to improve engine cleanliness, in particular in marine engines. This invention also concerns a method for improving engine cleanliness, in particular in marine engines, comprising the use of a lubricant composition comprising esters.

In the maritime sector, significant efforts are being concentrated on lubricant compositions in order to neutralise the sulphuric acid formed during fuel combustion, which allows for a significant decrease in the corrosive wear of the parts of the engine.

To address the issue of reducing corrosive wear, numerous additives are used in lubricant compositions, and may have adverse effects on the cleanliness of the engine parts, particularly that of the crankcase. In fact, when these additives are in contact with sulphuric acid and/or experience stresses due to the temperatures and pressures applied within the engine, they may break down partially or totally, forming deposits that clog these parts. As a result, the deposits formed induce increased wear and rapid clogging of engine parts, and, in turn, faster shortening of the useful life of the engines.

WO 2013/045648 describes lubricant compositions for marine engines allowing for reductions in fuel consumption whilst improving engine cleanliness. These compositions comprise at least one base oil, at least one detergent, at least one olefin copolymer, and at least one glycerol ester.

However, there remains an interest in providing lubricant compositions that offer even higher performance in terms of engine cleanliness.

Thus, a first object of this invention concerns the use in a lubricant composition comprising at least one base oil of 2 to 12 wt % (by weight of the lubricant composition) of an ester having a viscosity at 100° C. between 200 and 1000 cST to improve the cleanliness of an engine, preferably that of the crankcase.

In the context of this invention, improvements in engine cleanliness are defined by increases in the thermal stability of the lubricant, which results in a decrease in coating of the engine parts. The thermal stability of the lubricant is determined by the ECBT test as described below. It should be understood that improvements in engine cleanliness are relative to what is observed in the absence of esters according to the invention in the lubricant composition according to the invention.

Surprisingly, the inventors have shown that, with less than 1 wt % of ester or more than 14 wt % of ester, there was no improvement in engine cleanliness.

Preferably, the ester is included in a proportion of 2 to 11 wt %, preferably 3 to 11 wt %, more preferably 3 to 10 wt %, even more preferably 4 to 10 wt % by weight of the lubricant composition.

Preferably, the viscosity of the ester at 100° C., measured pursuant to standard ASTM D445, is between 200 and 900 cST, preferably between 200 and 800, more preferably between 250 and 700 cSt.

The esters according to this invention may be any time of ester obtained by reacting an alcohol and an acid. The alcohol may be a monoalcohol or a polyalcohol, and the acid may be a monoacid or a polyacid. In particular, the esters may be selected from the mono-, di-, tri-, tetra-, or pentaesters.

Preferably, the alcohols are monoalcohols, dialcohols, trialcohols, or tetraalcohols.

Preferably, the alcohol has a hydrocarbon chain comprising 1 to 3 carbon atoms, more preferably comprising 3 to 25 carbon atoms, even more preferably 3 to 18 carbon atoms. "Polyalcohol" refers to an alcohol having at least two hydroxyl groups, preferably comprising between 2 and 8 hydroxyl groups, more preferably between 2 and 6 hydroxyl groups, even more preferably between 2 and 4 hydroxyl groups.

Advantageously, the polyalcohols are selected from erythrytol, trimethylolpropane, and pentaerythrytol, preferably from trimethylolpropane and pentaerythritol.

Advantageously, the polyalcohol is not glycerol.

"Polyacid" refers to an acid having at least 2 carboxylic acid groups, preferably comprising between 2 and 6 carboxylic acid groups, more preferably between 2 and 4 carboxylic acid groups.

Preferably, the acids are selected from acid anhydrides or fatty acids.

Advantageously, the acid anhydrides are selected from ethanoic anhydrides, propanoic anhydrides, maleic anhydrides, phthalic anhydrides, cis-1,2,3,6-tetrahydrophtalic anhydrides, and succinic anhydrides.

Also advantageously, the fatty acids comprise 4 to 36 carbon atoms, preferably 6 to 24 carbon atoms. These fatty acids may be saturated, mono-, and/or polyunsaturated.

According to one particular embodiment of the invention, the fatty acids used for the reaction with the alcohols are, e.g., fatty acids from vegetable oil, and may be saturated, mono-, and/or polyunsaturated. They are chosen, for example, from caprylic, pelargonic, capric, undecylenic, lauric, tridecylenic, myristic, pentadecylic, palmitic, margaric, stearic, nonadecylic, arachic, heneicosylic, behenic, tricosylic, lignoceric, pentacosylic, cerotic, heptacosylic, montanic, nonacosylic, melissic, hentriacontylic, and lacceroic acid, and derivatives thereof, or unsaturated acids such as palmitoleic, oleic, erucic, nervonic, linoleic, a-linolenic, c-linolenic, di-homo-c-linolenic, arachidonic, eicosapentaenoic, and docosahexanoic acid, and derivatives thereof. Preferably, the fatty acids are derived from the hydrolysis of triglycerides present in vegetable and animal oils such as copra, palm, olive, peanut, rapeseed, sunflower, soya, castor, wood, corn, marrow, grapeseed, jojoba, sesame, nut, hazelnut, almond, shea, macadamia, alfalfa, rye, safflower, coconut, cottonseed, linseed oil, beef tallow, or any mixture thereof. Natural oils may have been genetically modified so as to enrich their content of certain fatty acids, e.g. rapeseed oil or oleic sunflower oil.

In one particular embodiment of the invention, the carbon chain of the acid anhydrides or fatty acids may be functionalised by one or more groups elected from carboxylic acids, amides, ureas, urethanes, amines, polyisobutadienes, or alcohols.

The esters according to the invention may be mixed esters, i.e. esters obtained by mixing various alcohols and/or various acids.

Thus, preferably, the esters according to the invention are obtained by reacting a monoalcohol or polyalcohol as defined above and a monoacid or polyacid as defined above.

Preferably, the ester according to the invention is not a glycerol ester.

Preferably, the lubricant composition further comprises at least one detergent. The detergents used in the lubricant compositions according to this invention are well known to persons skilled in the art.

In a particular embodiment of the invention, the detergents commonly used in the formulation of lubricant compositions are typical anionic compositions including a long, lipophilic hydrocarbon chain and a hydrophilic head.

The associated cation is typically a metallic cation of an alkaline or alkaline Earth metal.

The detergents are preferably selected from the carboxylic, sulphonate, salicylate, naphthenate, and phenate salts of alkaline or alkaline earth metals.

The alkaline and alkaline earth metals are preferably calcium, magnesium, sodium, or barium.

These metal salts may contain the metal in an approximately stoichiometric quantity. In this case, the detergents are referred to as not overbased or 'neutral', although they do contribute a certain basicity. These 'neutral' detergents typically have a BN (Base Number, characterising basicity), measured pursuant to ASTM D2896, of less than 150 mg KOH/g, or less than 100, or even less than 80 mg KOH/g.

This type of 'neutral' detergent may contribute in part to the BN of the lubricants according to this invention. For example, carboxylate, sulphonate, salicylate, phenate, or naphthenate neutral detergents of alkaline and alkaline earth metals, e.g. calcium, sodium, magnesium, or barium may be used.

If the metal is present in excess (quantity greater than the stoichiometric quantity), the detergent is 'overbased'. Their BN is elevated, greater than 150 mg KOH/g, typically between 200 and 700 mg KOH/g, generally between 250 and 450 mg KOH/g.

The excess metal that makes the detergent overbased may be present in the form of oil-insoluble metal salts, e.g. carbonate, hydroxide, oxalate, acetate, glutamate, or, preferably, carbonate.

In a single overbased detergent, the metals of these insoluble salts may be the same as those of the oil-soluble detergents, or they may be different. Preferably, they are selected from calcium, magnesium, sodium, and barium.

Overbased detergents are thus present in the form of micelles consisting of insoluble metal salts kept in suspension in the lubricant composition by the detergents in the form of oil-soluble metal salts.

These micelles may contain one or more types of insoluble metal salts, stabilised by one or more types of detergents.

The overbased detergents including a single type of soluble metal salt detergent will generally be named in accordance with the nature of the hydrophobic chain of the latter detergent.

Thus, they will be referred to as carboxylate, phenate, salicylate, sulphonate, or naphthenate, depending on whether the detergent is, respectively, a carboxylate, phenate, salicylate, sulphonate, or a naphthenate.

Overbased detergents will be referred to as 'mixed' if the micelles comprise several types of detergents, differing in terms of the nature of their hydrophobic chain.

For use in the lubricant compositions according to this invention, the oil-soluble metal salts will preferably be carboxylates, phenates, sulphonates, salicylates, and mixed phenate-sulphonate detergents, and/or salicylates of calcium, magnesium, sodium, or barium.

The insoluble metal salts that render the detergent overbased are alkaline and alkaline earth metal carbonates, preferably calcium carbonate.

The overbased detergents used in the lubricant compositions according to this invention will preferably be carboxylates, phenates, sulphonates, salicylates, and mixed phenate-sulphonate-salicylate detergents overbased with calcium carbonate.

According to the invention, the lubricant composition may also comprise detergents that may be selected, in particular, from:

soluble fatty amines, selected from:

compounds of formula (I):

$$R_1—[(NR_2)—R_3]_m—NR_4R_5,$$

wherein $R_1$ is a saturated or unsaturated, linear or branched hydrocarbon group comprising at least 12 carbon atoms and optionally at least one heteroatom selected from nitrogen, sulphur, or oxygen, $R_2$, $R_4$, or $R_5$ independently represent a hydrogen atom or a saturated or unsaturated, linear or branched hydrocarbon group, optionally comprising at least one heteroatom selected from nitrogen, sulphur, or oxygen, $R_3$ is a saturated or unsaturated, linear or branched hydrocarbon group comprising one or more carbon atoms and optionally at least one heteroatom selected from nitrogen, sulphur, or oxygen, preferably oxygen, m is an integer greater than or equal to 1, preferably between 1 and 10, more preferably between 1 and 6, even more preferably selected from 1, 2, or 3, or a mixture of fatty polyalkylamines comprising one or more polyalkylamines of formula (III) and/or (IV):

(III)

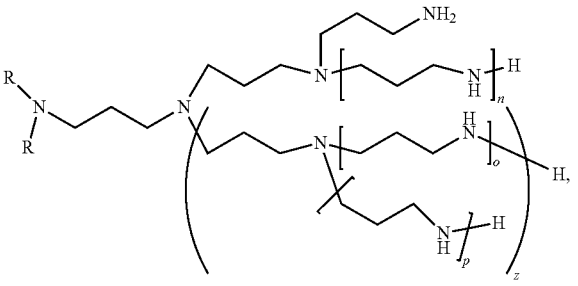

(IV)

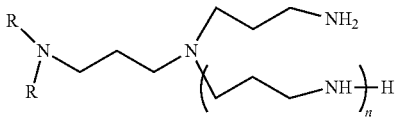

wherein,

R is identical or different, and represents a linear or branched alkyl group comprising 8-22 carbon atoms, n and z independently represent 0, 1, 2, or 3, and when z is greater than 0, o and p independently represent 0, 1, 2, or 3, wherein the mixture comprises at least 3 wt % of branched compounds such that at least one of n or z is greater than or equal to 1, or derivatives thereof, or mixtures of fatty amines of formula (I), (III), and/or (IV), a detergent based on alkaline or alkaline earth metals, overbased by metal carbonate salts.

The fatty amines of formula (I) included in the lubricant composition are described, in particular, in applications WO 2009/153453 and WO 2014/180843, filed by the applicant.

In a preferred embodiment of the invention, the fatty amine of formula (I) or the mixture of fatty amines of formula (III) and/or (IV), or the mixture of fatty amines of formula (I), (III), and/or (IV) is added in a quantity of 0.1 to 15 wt %, preferably 0.5 to 10 wt %, preferably 0.5 to 8 wt %, or 3 to 10 wt % by weight of the total weight of the lubricant composition.

According to the invention, 'fatty amine' refers to an amine of formula (I), (III), or (IV) comprising one or more hydrocarbon groups that is saturated or unsaturated, linear or branched, and optionally comprises at least one heteroatom selected from nitrogen, sulphur, and oxygen, preferably oxygen. According to the invention, 'several fatty amines' refers to a mixture of fatty amines, at least one fatty acid of which is of formula (I), (III), and/or (IV).

In particular, the fatty amines of formula (I), (III), or (IV) are as described in WO2017021426.

Particularly advantageously, this invention concerns improving the cleanliness of a marine engine, in particular a 2- or 4-stroke marine engine. More specifically, the invention concerns improving the cleanliness of a 2-stroke marine engine, in particular that of the crankcase. For 2-stroke engines, the lubricant is used, in particular, as a cylinder or system oil, preferably a cylinder oil.

In a particular embodiment of the invention, the base oil included in the lubricant composition is selected from mineral, synthetic, or vegetable oils, as well as mixtures thereof.

The mineral or synthetic oils generally used in this application belong to one of the classes defined in the API classification, as summarised in the table below.

| | Saturated content | Sulphur content | Viscosity index |
|---|---|---|---|
| Group 1: Mineral oils | <90% | >0.03% | 80 ≤ VI < 120 |
| Group 2: Hydrocracked oils | ≥90% | ≤0.03% | 80 ≤ VI < 120 |
| Group 3: Hydroisomerised oils | ≥90% | ≤0.03% | ≥120 |
| Group 4: | PAO | | |
| Group 5: | Other bases not included in groups 1-4. | | |

The mineral oils of Group 1 may be obtained by distilling selected naphthenic or paraffinic crudes, followed by purification of these distillates by methods such as solvent extraction, solvent or catalytic dewaxing, hydrotreatment, or hydrogenation.

The oils of Groups 2 and 3 are obtained by more rigorous purification methods, e.g. a combination of hydrotreatment, hydrocracking, hydrogenation, and catalytic dewaxing.

Examples of synthetic bases of Groups 4 and 5 include poly-alpha olefins, polybutenes, polyisobutenes, and alkylbenzenes.

These base oils may be used alone or in mixtures. A mineral oil may be combined with a synthetic oil.

Cylinder oils for diesel 2-stroke marine engines have a viscosimetric grade of SAE-40-SAE-60, generally SAE-50, equivalent to a kinematic viscosity at 100° C. between 16.3 and 21.9 $mm^2/s$.

Grade 40 oils have a kinematic viscosity at 100° C. between 12.5 and 16.3 $mm^2/s$.

Grade 50 oils have a kinematic viscosity at 100° C. between 16.3 and 21.9 $mm^2/s$.

Grade 60 oils have a kinematic viscosity at 100° C. between 21.9 and 26.1 V.

This viscosity may be obtained by mixing additives and base oils, e.g. containing mineral bases of Group 1 such as Neutral Solvent bases (e.g. 500 NS pr 600 NS) and Bright-stock. Any other combination of mineral, synthetic, or vegetable bases having a viscosity, in mixture with additives, that is compatible with grade SAE-50 may be used.

Typically, a classic cylinder lubricant formulation for diesel 2-stroke marine engines is grade SAE 40-SAE60, preferably SAE50 (according to the SAE J300 classification), and comprises at least 50 wt % of lubricant base oil of mineral and/or synthetic origin, adapted for use in a marine engine, e.g. of API Group 1, i.e. obtained by distilling selected crudes, followed by purification of these distillates by methods such as solvent extraction, solvent or catalytic dewaxing, hydrotreatment, or hydrogenation. Their viscosity index (VI) is between 80 and 120; their sulphur content is greater than 0.03%, and their saturate content is less than 90%.

In one particular embodiment of the invention, the lubricant composition may further comprise one or more thickening additives that serve to increase the viscosity of the composition, both in hot and cold conditions, or additives that improve the VI.

Preferably, these additives are most frequently polymers with low molecular weight, on the order of 2000 50,000 Da (Mn). They may be selected from PIB (on the order of 2000 Da), polyacrylates or polymethacrylates (on the order of 30,000 Da), olefin copolymers, olefin and alpha olefin copolymers, EPDM, polybutenes, high-molecular-weight poly-alpha-olefins (viscosity at 100° C.>150), styrene-olefin copolymers, whether hydrogenated or not.

According to a particular embodiment of the invention, the base oil(s) included in the lubricant composition of the invention may be totally or partially substituted with these additives. Thus, the polymers used to substitute one or more of the base oils partially or totally are preferably the aforementioned PIB thickeners (e.g. those marketed under the name Indopol H2100).

In a particular embodiment of the invention, the lubricant composition may further comprise at least one anti-wear additive. Preferably, the anti-wear additive is zinc dithiophosphate or DTPZn. This category also includes various phosphorus, sulphur, nitrogen, chlorine, and boron compounds. There is a wide variety of anti-wear additives, but the most widely used category is that of the phosphosulphur additives such as metal alkylthiophosphates, in particular zinc alkylthiophosphates, more specifically zinc dialkyldithiophosphates or DTPZn. Amine phosphates, polysulphides, in particular sulphurous olefins, are also commonly used anti-wear additives.

Lubricant compositions commonly also include anti-wear and extreme-pressure nitrogen and sulphur additives, such as metal dithiocarbamates, in particular molybdenum dithiocarbamate. Glycerol esters are also anti-wear additives. These include, for example, mono-, di-, and trioleates, monopalmitates, and monomyristates.

In a particular embodiment of the invention, the lubricant composition may further comprise at least one dispersant. Dispersants are well-known additives used in the formulation of lubricant compositions, in particular for marine applications. Their primary role is to keep the particles initially present in the lubricant composition or appearing in it over the course of its use in the engine in suspension. They prevent their agglomeration by acting on steric hindrance. They may also have a synergistic effect on neutralisation. Dispersants used as lubricant additives typically contain a polar group, associated with a relatively long hydrocarbon chain, generally containing 50 to 400 carbon atoms. The polar group typically contains at least one nitrogen, oxygen, or phosphorus component. Dispersant compounds derived from succinic acid are particularly widely used as lubrication additives. In particular, succinimides obtained by condensing succinic anhydrides and amines, as well as succinic esters obtained by condensing succinic anhydrides and alcohols or polyols are used. These compounds may subsequently be treated with various compounds, in particular sulphur, oxygen, formaldehyde, carboxylic acids, and compounds containing boron or zinc, e.g. to produce borated succinimides or zinc-blocked succinimides. Mannich bases, obtained by polycondensation of phenols substituted with alkyl groups, formaldehyde, and primary or secondary amines, are also used as dispersants in lubricants. A dispersant of the PIB succinimide family, e.g. one borated or blocked with zinc, may be used.

In a particular embodiment of the invention, the lubricant composition may further comprise all suitable types of functional additives, e.g. anti-foaming additives to counteract the effect of the detergents, which may be, e.g. polar polymers such as polymethylsiloxanes, polyacrylates, antioxidants, and/or anti-rust additives, e.g. organometallic or thiadiazole detergents. These are known to persons skilled in the art.

According to this invention, the compositions of the aforementioned lubricants refer to the compounds taken separately prior to mixing; it should be noted that such compounds may or may not remain in the same chemical form both before and after mixing. Preferably, the lubricants according to this invention that are obtained by mixing separate compounds are not in the form of an emulsion or microemulsion.

Preferably, the base oil of the composition according to the invention is a group 2 base oil.

This invention also concerns the use of a lubricant composition comprising at least one base oil and 2 to 12 wt % (by weight of the lubricant composition) of an ester compound having a viscosity at 100° C., measured pursuant to ASTM D445, between 100 and 1000 cST in order to improve engine cleanliness. The quantities of esters, the esters, base oil, and the lubricant composition, and any additives, are as defined above.

This invention also concerns a lubricant composition comprising at least one base oil and 2 to 12 wt % (by weight of the lubricant composition) of an ester having a viscosity at 100° C., measured pursuant to standard ASTM D445, between 100 and 1000 cST in order to improve engine cleanliness. The quantities of esters, the esters, base oil, and the lubicant composition, and any additives, are as defined above.

This application will now be described by reference to non-limiting examples.

EXAMPLE 1

Compositions According to the Invention and Comparative Compositions

The esters of table 1 were used in the lubricant compositions tested below.

| Ester | Viscosity at 100° C. (cSt) |
|---|---|
| Ester 1 (according to the invention) | 600 |
| Ester 2 (according to the invention) | 315 |
| Ester 3 (according to the invention) | 589 |
| Ester 4 (comparative) | 98 |
| Ester 5 (comparative) | 36 |
| Ester 6 (comparative) | 12 |

The following compositions were prepared (CI=composition according to the invention, CC=comparative composition):

TABLE 2

| | CI1 | CI2 | CI3 | CI4 | CI5 | CI6 | CC1 | CC2 | CC3 | CC4 | CC5 | CC6 |
|---|---|---|---|---|---|---|---|---|---|---|---|---|
| Base oil (wt %) | 79.7 | 79.7 | 79.7 | 84.2 | 84.2 | 84.2 | 88.6 | 79.7 | 79.7 | 79.7 | 87.71 | 75.3 |
| Ester 1 (wt %) | 8.9 | | | 4.4 | | | | | | | 0.89 | 13.3 |
| Ester 2 (wt %) | | 8.9 | | | 4.4 | | | | | | | |
| Ester 3 (wt %) | | | 8.9 | | | 4.4 | | | | | | |
| Ester 4 (wt %) | | | | | | | | 8.9 | | | | |
| Ester 5 (wt %) | | | | | | | | | 8.9 | | | |
| Ester 6 (wt %) | | | | | | | | | | 8.9 | | |
| Detergent packet | 11.4 | 11.4 | 11.4 | 11.4 | 11.4 | 11.4 | 11.4 | 11.4 | 11.4 | 11.4 | 11.4 | 11.4 |

The properties of these compositions are described in table 3 below.

TABLE 3

| Composition | CI1 | CI2 | CI3 | CI4 | CI5 | CI6 | CC1 | CC2 | CC3 | CC4 | CC5 | CC6 |
|---|---|---|---|---|---|---|---|---|---|---|---|---|
| Viscosity at 40° C. (mm2/s) | 117.5 | 189.2 | 170.2 | 198 | 181 | 200.5 | 217.6 | 196.8 | 189 | 201.6 | 216.0 | 151.9 |
| Viscosity at 100° C. (mm2/s) | 19.7 | 19.74 | 18.1 | 19.36 | 17.72 | 19.3 | 19.02 | 19 | 18.08 | 18.8 | 19.6 | 19.6 |
| VI | 128 | 131 | 118 | 111 | 107 | 109 | 98 | 109 | 105 | 104 | 103 | 148 |
| BN (KOH/g) | 25.1 | 24.9 | 25.1 | 25.2 | 25 | 25.3 | 25.3 | 25.1 | 25 | 25.3 | 25.2 | 25 |

Viscosity at 40° C. is measured according to standard ASTM D7279.

Viscosity at 100° C. is measured according to standard ASTM D7279.

The VI corresponds to the viscosity index, and is calculated according to standard NF ISO 2909.

The BN corresponds to the base number, measured according to standard ASTM D2896.

EXAMPLE 2

Evaluation of the Properties of the Lubricant Compositions According to the Invention To evaluate the properties of the lubricant compositions according to the invention, ECBT tests were conducted.

These tests allow fora simulation of the appearance of a coating on the parts of the engine.

The temperature resistance of the compositions was thus evaluated by means of the ECBT test. A detailed description of this test can be found in the publication "Research and Development of Marine Lubricants in ELF ANTAR France—The relevance of laboratory tests in simulating field performance", by Jean-Philippe ROMAN, MARINE PROPULSION CONFERENCE 2000—AMSTERDAM—29-30 Mar. 2000.

The results are shown in table 4 below.

The results show that the compositions according to the invention have good temperature resistance, and are thus able to improve engine cleanliness.

TABLE 4

| | COMPOSITIONS | | | | | |
|---|---|---|---|---|---|---|
| | CI1 | CI2 | CI3 | CI4 | CI5 | CI6 |
| Score at 280° C. | 73.6 | 92.3 | 88.5 | 62.9 | 63.9 | 45.7 |
| Critical temperature measured at score of 50 | 289° C. | 289° C. | 295° C. | 285° C. | 283° C. | 282° C. |

| | COMPOSITIONS | | | | | |
|---|---|---|---|---|---|---|
| | CC1 | CC2 | CC3 | CC4 | CC5 | CC6 |
| Score at 280° C. | 32.2 | 40.1 | 34.1 | 28.8 | 12.2 | 47 |
| Critical temperature measured at score of 50 | 277° C. | 278° C. | 277° C. | 276° C. | 274° C. | 279° C. |

When determining the score at 280° C., if the surface is free of coating, the score is 100. In other words, the lower the score, the more coating there is on the surface.

The critical temperature corresponds to the temperature at which the surface has a coating with a score of 50.

These results show that esters having a viscosity according to the invention allow advantageously for improvements in engine cleanliness compared to lubricant compositions lacking such esters and compared to lubricant compositions comprising esters having different viscosities. In fact, the coating score is closer to 100 with the esters according to the invention. Additionally, the critical temperature is considerably greater for the esters according to the invention.

These results also show the influence of the quantity of ester used.

The invention claimed is:

1. A method for improving the cleanliness of a marine engine comprising lubricating the engine with a lubricant composition comprising at least one base oil and 2 to 12 wt % (by weight of the lubricant composition) of an ester having a viscosity at 100° C. between 250 and 1000 cSt, wherein the ester is not a glycerol ester, and wherein the ester is obtained by reacting an alcohol and an acid that comprises from 4 to 36 carbon atoms.

2. The method according to claim 1, wherein the viscosity of the ester at 100° C. is between 250 and 900 cSt.

3. The method according to claim 1, wherein the ester is included in a proportion of 2 to 11 wt % by weight of the lubricant composition.

4. The method according to claim 1, wherein the ester is obtained by reacting an alcohol and an acid, and wherein the alcohol forming the ester is a monoalcohol.

5. The method according to claim 1, wherein the ester is obtained by reacting an alcohol and an acid, and wherein the acid forming the ester is selected from the group consisting of acid anhydrides and fatty acids.

6. The method according to claim 4, wherein the acid is selected from the group consisting of acid anhydrides and fatty acids.

7. The method according to claim 5, wherein the carbon chain of the acid anhydrides or fatty acids is functionalized by one or more groups selected from the group consisting of carboxylic acids, amides, ureas, urethanes, amines, polyisobutadienes, and alcohols.

8. The method according to claim 6, wherein the carbon chain of the acid anhydrides or fatty acids is functionalized by one or more groups selected from the group consisting of carboxylic acids, amides, ureas, urethanes, amines, polyisobutadienes, and alcohols.

9. The method according to claim 1, wherein the engine is a 2-stroke marine engine.

10. The method according to claim 1, wherein the ester is obtained by reacting an alcohol and an acid, and wherein the alcohol forming the ester is a polyalcohol.

* * * * *